US009067233B2

(12) United States Patent
Noguchi et al.

(10) Patent No.: US 9,067,233 B2
(45) Date of Patent: Jun. 30, 2015

(54) STICK-SHAPED MATERIAL PROPELLING CONTAINER

(71) Applicant: Kotobuki & Co., Ltd., Kawagoe (JP)

(72) Inventors: Yoshio Noguchi, Saitama (JP); Hidehei Kageyama, Saitama (JP)

(73) Assignee: Kotobuki & Co., Ltd., Kawagoe, Saitama (JP)

( * ) Notice: Subject to any disclaimer, the term of this patent is extended or adjusted under 35 U.S.C. 154(b) by 0 days.

(21) Appl. No.: 14/255,768

(22) Filed: Apr. 17, 2014

(65) Prior Publication Data

US 2015/0023715 A1 Jan. 22, 2015

(30) Foreign Application Priority Data

Jul. 19, 2013 (JP) ..... 2013-150887

(51) Int. Cl.

| | |
|---|---|
| ***A45D 40/04*** | (2006.01) |
| ***B05C 17/01*** | (2006.01) |
| ***A45D 40/06*** | (2006.01) |
| ***B43K 23/016*** | (2006.01) |
| ***B43L 19/00*** | (2006.01) |
| ***B43M 11/06*** | (2006.01) |
| ***B43K 24/06*** | (2006.01) |

(52) U.S. Cl.

CPC ..... *B05C 17/012* (2013.01); *A45D 40/04* (2013.01); *A45D 40/06* (2013.01); *B43K 23/016* (2013.01); *B43L 19/0081* (2013.01); *B43M 11/06* (2013.01); *B43K 24/06* (2013.01); *B43L 19/0075* (2013.01)

(58) Field of Classification Search

CPC combination set(s) only.
See application file for complete search history.

(56) References Cited

U.S. PATENT DOCUMENTS

2006/0222440 A1* 10/2006 Bauer et al. ..... 401/88

FOREIGN PATENT DOCUMENTS

| | | |
|---|---|---|
| JP | 2549741 Y2 | 9/1993 |
| JP | 07-28144 Y2 | 6/1995 |

* cited by examiner

*Primary Examiner* — David Walczak
(74) *Attorney, Agent, or Firm* — McGinn IP Law Group, PLLC

(57) ABSTRACT

A stick-shaped material propelling container which comprises a barrel having a spiral groove formed in its inner peripheral surface, a guide tube having slits and inserted in the barrel so as to be rotatable relative to the barrel and axially unmovable, and a stick-shaped material holding member provided with side plates and protrusions and slidably inserted in the tube with the protrusions being engaged with the grooves through the slits. The groove has a structure for causing rear end portions of the side plates to come closer to each other and for causing tip end portions of the side plates to be separated radially outward from each other according to the mutually approaching movements of the rear end portions of the side plates, when the protrusions are slid along a tip end portion of the groove according to relative rotation of the barrel and the tube.

12 Claims, 10 Drawing Sheets

STICK-SHAPED MATERIAL PROPELLING CONTAINER

TECHNICAL FIELD

The present invention relates to a stick-shaped material propelling container in which a stick-shaped material held by a holding member is adapted to be propelled from an open tip end portion of an outer barrel of the container.

BACKGROUND ART

In the past, as this kind of stick-shaped material propelling containers, there were known stick-shaped material propelling containers (Patent Literatures 1 and 2), each of which comprises an outer barrel having a spiral groove formed in an inner peripheral surface thereof, an inner barrel inserted in the outer barrel so as to be rotatable relative to the outer barrel, a lock means for preventing the inner barrel from axially moving relative to the outer barrel, and a stick-shaped material holder holding a stick-shaped material and slidably inserted in the inner barrel. In such a stick-shaped material propelling container, the stick-shaped material holder is provided with two holding pieces for interposingly holding the stick-shaped material therebetween, and the inner barrel has two slits formed correspondingly with the holding pieces. Moreover, the stick-shaped material holder is provided on an outer surface thereof with protrusions which are engaged in the spiral groove of the outer barrel through the slits of the inner barrel. In the stick-shaped material propelling container, by causing the outer barrel and the inner barrel to be rotated relative to each other, the stick-shaped material holder is rotated together with the inner barrel while sliding along the spiral groove of the outer barrel via the protrusions of the stick-shaped material holder and is moved in a forward/rearward direction along the slits of the inner barrel.

LIST OF PRIOR ART REFERENCES

Patent Literatures

Patent Literature 1: Japanese Examined Utility Model Application Publication No. Hei. 7-28144

Patent Literature 2: Japanese Utility Model Registration No. 2549741

SUMMARY OF THE INVENTION

Problems to be Solved by the Invention

Incidentally, for example, in a case where after assembling of the stick-shaped material propelling container disclosed in the patent literature 1, the stick-shaped material is required to be removed from the stick-shaped material holder or required to be replaced with another stick-shaped material, even if the stick-shaped material holder is slid toward an open tip end portion of the outer barrel along the slits by causing the outer barrel and the inner barrel to be rotated relative to each other and, according to the sliding movement of the stick-shaped material holder, a tip end portion of the stick-shaped material held by the stick-shaped material holder is propelled out of the open tip end portion of the outer barrel, the stick-shaped material cannot be easily removed from the stick-shaped material holder, since the holding pieces of the stick-shaped material holder securely hold the stick-shaped material therebetween.

In the stick-shaped material propelling container disclosed in the patent literature 2, when the outer barrel and the inner barrel are rotated relative to each other, the holding pieces of the stick-shaped material holder are adapted to be operatively projected out of the open tip end portion of the outer barrel of the container. The holding pieces of the stick-shaped material holder are previously designed so that they are deformed outward relative to each other in a radial direction of the outer barrel when the holding pieces are projected out of the open tip end portion of the outer barrel. Therefore, when the holding pieces of the stick-shaped material holder are projected out of the open tip end portion of the outer barrel, the holding pieces of the stick-shaped material holder are made easy to release the stick-shaped material therefrom. However, in a case where the stick-shaped material is a viscous material, the stick-shaped material cannot be easily removed from the stick-shaped material holder since an outer peripheral surface of the stick-shaped material strongly adheres to the holding pieces. In addition, the stick-shaped material holder is normally brought into a state in which it is contained in the inner barrel and holds the stick-shaped material, so that radially outward deformation forces of the holding pieces may fall due to degradation with the passage of time. Therefore, in the case where the radially outward deformation forces of the holding pieces have fallen, even if the holding pieces of the stick-shaped material holder are operatively projected out of the open tip end portion of the outer barrel, the holding pieces may not be sufficiently deformed outward so as to allow the easy removal of the stick-shaped material from the holding pieces.

It is therefore an object of the present invention to provide a stick-shaped material propelling container which always allows a stick-shaped material to be easily removed from a stick-shaped material holding member and, thus, allows easy replacement of various stick-shaped materials having the substantially same diameter.

Means to Solve the Problems

In accordance with the present invention, there is provided a stick-shaped material propelling container which comprises:

an outer barrel opened at least at a tip end portion thereof and having a spiral groove formed in an inner peripheral surface thereof;

a guide tube opened at least at a tip end portion thereof and having a peripheral wall and a plurality of axially extending guide slits formed in the peripheral wall;

the guide tube being inserted in the outer barrel so as to be rotatable relative to the outer barrel and unmovable in an axial direction of the outer barrel; and a holding member for holding a stick-shaped material;

the holding member comprising a bottom plate, on which the stick-shaped material is carried, a plurality of side plates for interposingly holding the stick-shaped material carried on the bottom plate, the plurality of side plates extending in a forward/rearward direction from side edge regions of the bottom plate, and engaging protrusions protruding laterally from rear end portions of the side plates with respect to the bottom plate;

the holding member being slidably inserted in the guide tube in a state where the side plates or the engaging protrusions of the holding member are engaged with the guide slits of the guide tube, and the engaging protrusions of the holding member are engaged with the spiral groove of the outer barrel through the guide slits of the guide tube; and the holding member being adapted to be moved in the forward/rearward direction along the guide slits of the guide tube while being rotated relative to the outer barrel with the engaging protrusions being slid along the spiral groove of the outer barrel, by relative rotation of the outer barrel and the guide tube; and wherein the spiral groove has a structure for causing rear end portions of the side plates of the holding member to come closer to each other in a radial direction of the outer barrel and for causing tip end portions of the side plates of the holding member to be separated radially outward from each other according to the mutually approaching movements of the rear end portions of the side plates of the holding member, when the engaging protrusions of the holding member are slid along a tip end portion of the spiral groove according to the relative rotation of the outer barrel and the guide tube.

In a first embodiment of the present invention, the structure of the spiral groove comprises a first spiral groove portion formed in an inner peripheral surface of the tip end portion of the outer barrel, and a second spiral groove portion continuously extending rearward from a rear end of the first spiral groove portion, and a radius which is measured between a virtual axial-center line of the outer barrel and the first spiral groove portion is made shorter than a radius which is measured between the virtual axial-center line and the second spiral groove portion.

In a second embodiment of the present invention, a depth of the first spiral groove portion is made shallower than a depth of the second spiral groove portion.

In a third embodiment of the present invention, a middle region of the bottom plate between the side plates of the holding member is made thinner than a remaining region of the bottom plate around the middle portion.

In a fourth embodiment of the present invention, a middle region of a rear surface of the bottom plate between the side plates is formed with a depressed portion.

In a fifth embodiment of the present invention, a middle region of the bottom plate which is spaced at an equal interval from the side plates is curved so as to protrude forward as compared to a remaining region of the bottom plate around the middle region.

Advantageous Effects

The stick-shaped material propelling container according to the present invention is configured as discussed above, so that it exerts the following effects. That is, according to the present invention, the spiral groove has the structure for causing the rear end portions of the side plates of the holding member to come closer to each other in the radial direction of the outer barrel and for causing the tip end portions of the side plates of the holding member to be separated radially outward from each other according to the mutually approaching movements of the rear end portions of the side plates of the holding member, when the engaging protrusions of the holding member are slid along the tip end portion of the spiral groove according to the relative rotation of the outer barrel and the guide tube, so that the stick-shaped material can be easily removed from the holding member in the state where the tip end portions of the side plates have been separated radially outward from each other. Therefore, according to the present invention, it is possible to provide a stick-shaped material propelling container which can handle various stick-shaped materials having the substantially same diameter.

The third, fourth, and fifth embodiments of the present invention can exert the following effects in addition to the above-mentioned effects. In the stick-shaped material propelling container according to the third embodiment, the middle region of the bottom plate between the side plates of the holding member is made thinner than the remaining region of the bottom plate around the middle portion, whereby the bottom plate is made easy to be flexibly deformed. In the stick-shaped material propelling container according to the fourth embodiment, the middle region of the rear surface of the bottom plate between the side plates of the holding member is formed with the depressed portion, whereby the bottom plate is made easy to be flexibly deformed. In the stick-shaped material propelling container according to the fifth embodiment, the middle region of the bottom plate which is spaced at the equal interval from the side plates of the holding member is curved so as to protrude forward as compared to the remaining region of the bottom plate around the middle region, whereby the bottom plate is made easy to be flexibly deformed. Therefore, these embodiments can facilitate the mutually approaching movements of the rear end portions of the side plates and facilitate the radially outward separating movements of the tip end portions of the side plates according to the mutually approaching movements of the rear end portions of the side plates. Moreover, the flexible deformation of the bottom plate makes it possible to reduce a contact area between the bottom plate and the stick-shaped material, so that the stick-shaped material is made easier to be removed from the holding member.

MODES FOR CARRYING OUT THE INVENTION

Embodiments of a stick-shaped material propelling container according to the present invention will be explained in detail hereinafter with reference to the accompanying drawings.

Figure 1A:
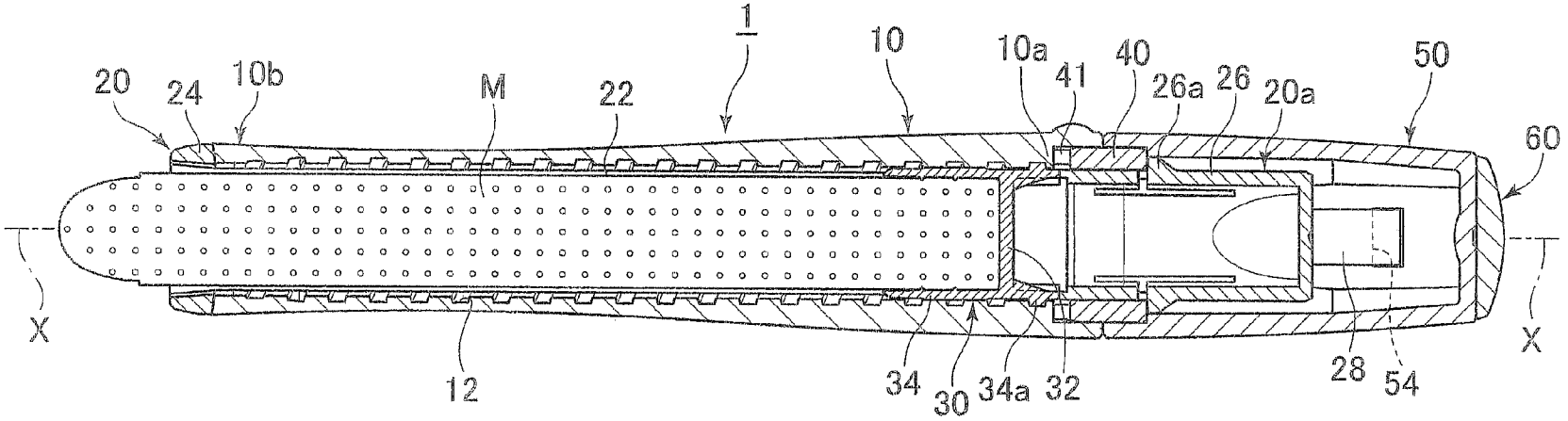
FIG. 1(A) is a vertically sectional view of a stick-shaped material propelling container according to an embodiment of the present invention.
Figure 1B:
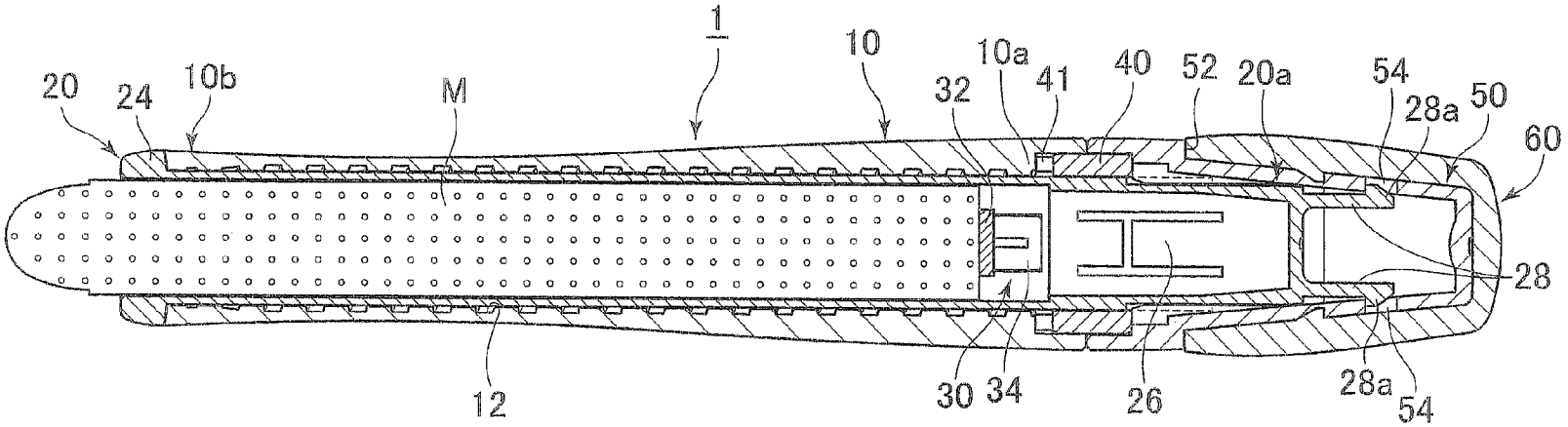
FIG. 1(B) is a vertically sectional view of the stick-shaped material propelling container shown in FIG. 1(A), in which a guide tube of the stick-shaped material propelling container is brought into a state where it is rotated through about 90 degrees relative to an outer barrel of the stick-shaped material propelling container.

Referring to FIGS. 1(A) and 1(B), there is illustrated an entire stick-shaped material propelling container 1 according to an embodiment of the present invention. The stick-shaped material propelling container 1 comprises an outer barrel 10, a guide tube 20 inserted in the outer barrel 10 so as to be rotatable relative to the outer barrel 10 but unmovable in an axial direction of the outer barrel 10, and a holding member 30 slidably inserted in the guide tube 20 for holding a stick-shaped material M.

As the stick-shaped material M, there may be employed a stick-shaped drawing material, a crayon, a stick-shaped eraser, a stick-shaped solid glue, a correction stick, an eyebrow stick, an eyeliner stick, a lip stick, etc. However, the stick-shaped materials to be used in the stick-shaped material propelling container according to the present invention are not limited to the above-mentioned stick-shaped materials.

Figure 2A:
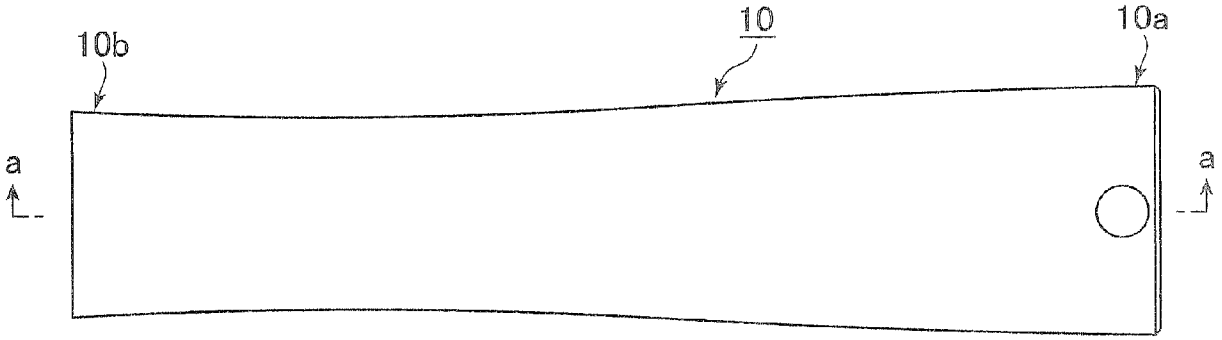
FIG. 2(A) is an external appearance view of the outer barrel.
Figure 2B:
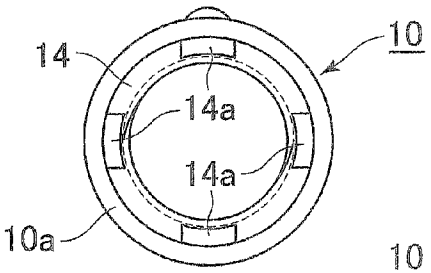
FIG. 2(B) is a view of the outer barrel as viewed from a rearward direction.
Figure 2C:
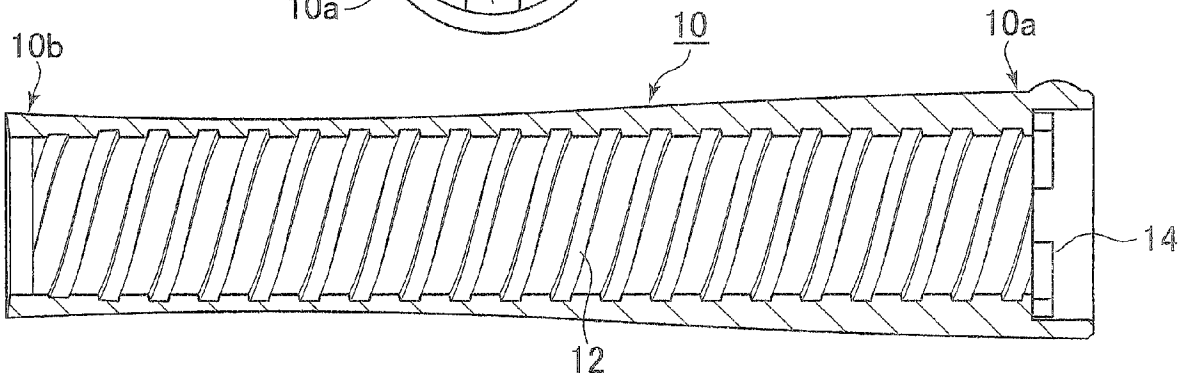
FIG. 2(C) is a vertically sectional view of the outer barrel, taken along a line a-a in FIG. 2(A)

Referring to FIGS. 2(A) and 2(C), the outer barrel 10 is formed into a barrel-shape and has an open rear end portion 10*a* and an open tip end portion 10*b*. The outer barrel 10 has an inner periphery with a substantially constant diameter from the tip end portion 10*b* toward the rear end portion 10*a*. The rear end portion 10*a* has an inner peripheral surface of an increased diameter which is provided with an annular step-shaped portion 14. Referring to FIG. 2(B), the step-shaped portion 14 has a plurality of spaced apart arcuate recesses 14*a* formed therein. Again referring to FIG. 2(C), the outer barrel 10 has a spiral groove 12 formed in an inner peripheral surface thereof and extending from the tip end portion 10*b* to a portion immediately before the step-shaped portion 14.

Figures 3A, 3B, 3C, 3D:
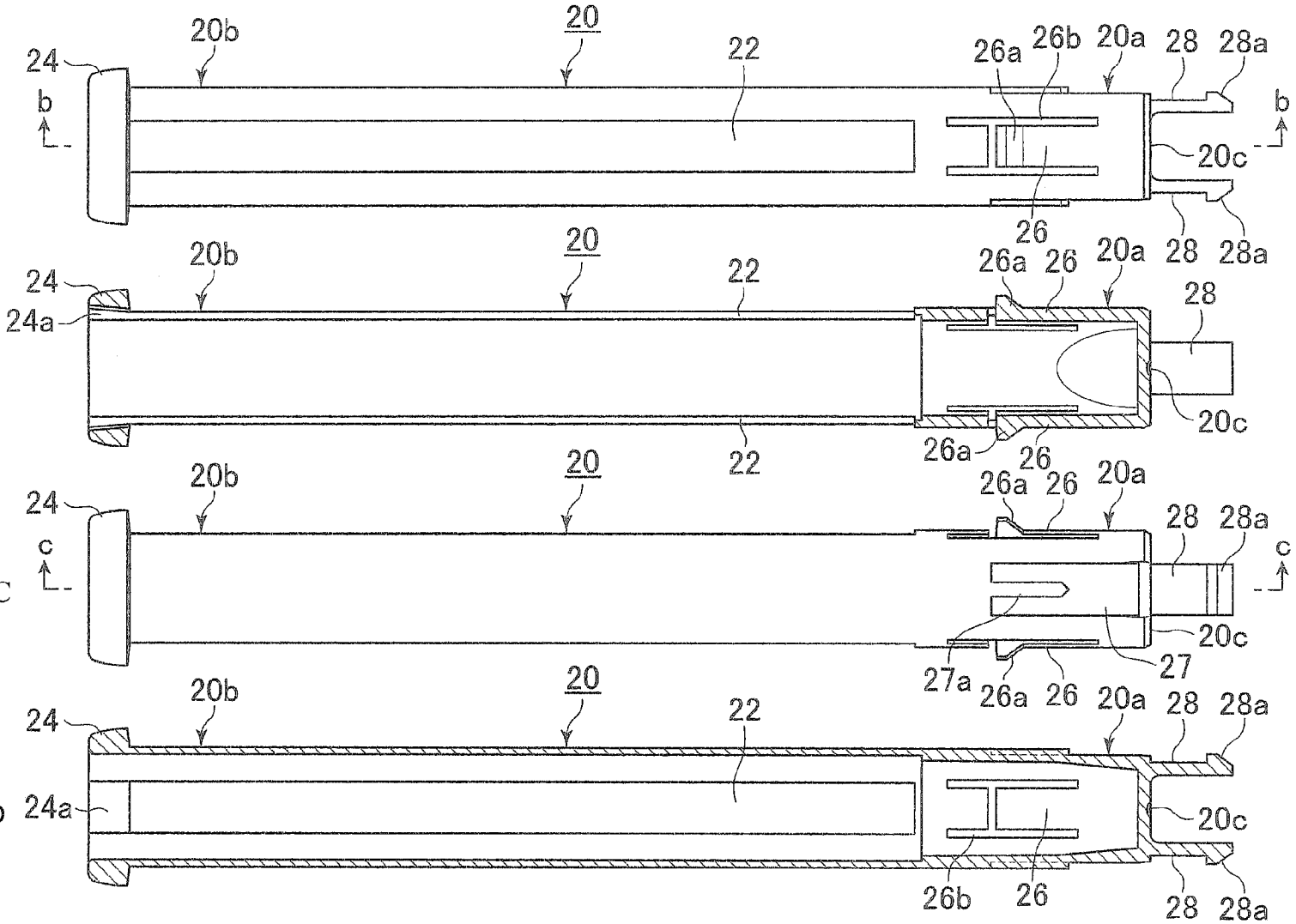
FIG. 3(A) is an external appearance view of the guide tube.
FIG. 3(B) is a vertically sectional view of the guide tube, taken along a line b-b in FIG. 3(A)
FIG. 3(C) is an external appearance view of the guide tube of FIG. 3(A) in a state where it is rotated through about 90 degrees.
FIG. 3(D) is a vertically sectional view of the guide tube, taken along a line c-c in FIG. 3(C)

Referring to FIG. 3, the guide tube 20 is formed into a bottomed tube-shape and opened at a tip end portion thereof. As discussed above, the guide tube 20 is inserted in the outer barrel 10 so as to be rotatable relative to the outer barrel 10 and unmovable in the axial direction of the outer barrel 10. The guide tube 20 includes a rear side section 20*a* having stopper pieces 26 which will be described hereinafter, and a front side section 20*b* having guide slits 22 which will be described hereinafter. In the following, the rear side section 20*a* is referred to as "a rear side tubular section" and the front side section 20*b* is referred to as "a front side tubular section". An outer peripheral surface of the tip end portion of the guide tube 20 is protruded outward in a radial direction of the guide tube 20, to thereby form an annular flange portion 24. An outer diameter of a rear end of the flange portion 24 is larger than an inner diameter of the tip end portion 10*b* of the outer barrel 10. Referring to FIGS. 3(B) and 3(D), the front side tubular section 20*b* of the guide tube 20 has two axially extending guide slits 22 formed in regions thereof which are opposite each other in the radial direction of the guide tube 20. The pair of guide slits 22 extends from a rear end of the front side tubular section 20*b* of the guide tube 20 to the rear end of the flange portion 24. Moreover, grooves 24*a* are formed in an inner peripheral surface of the flange portion 24 so as to communicate with the guide slits 22. The grooves 24*a* are made gradually deeper toward front ends from rear ends thereof.

As shown in FIG. 3, the rear side tubular section 20*a* of the guide tube 20 is provided with two axially extending stopper pieces 26. The stopper pieces 26 are formed at regions of a peripheral wall of the rear side tubular section 20*a* which are opposite each other in the radial direction of the guide tube 20. In this embodiment, as shown in FIGS. 3(A) and 3(D), the stopper pieces 26 are formed by making substantially H-shaped-cuts 26*b* into the regions of the peripheral wall of the rear side tubular section 20*a* which are opposite each other in the radial direction of the guide tube 20. A tip end portion of each of the stopper pieces 26 is provided with a stopper protrusion 26*a* which protrudes outward in the radial direction of the guide tube 20. As shown in FIG. 3(C), the rear side tubular section 20*a* has generally flat step portions 27 which are formed at opposite regions of an outer surface of the peripheral wall of the rear side tubular section 20*a* in the radial direction of the guide tube 20. An engagingly stopping rib 27*a* is provided at each of the step portions 27 so as to extend toward a rear end from a tip end edge of the step portion 27. A rear end of the rear side tubular section 20*a* is closed by a bottom portion 20*c*. The rear side tubular section 20*a* further has two engagingly stopping pieces 28 which are provided at opposite regions of a rear surface of the bottom portion 20*c* in the radial direction of the guide tube 20 and extend rearward from the bottom portion 20*c*. Each of the engagingly stopping pieces 28 is provided at a rear end portion thereof with an engagingly stopping pawl 28*a* which protrudes outward in the radial direction of the guide tube 20.

Figure 5A:
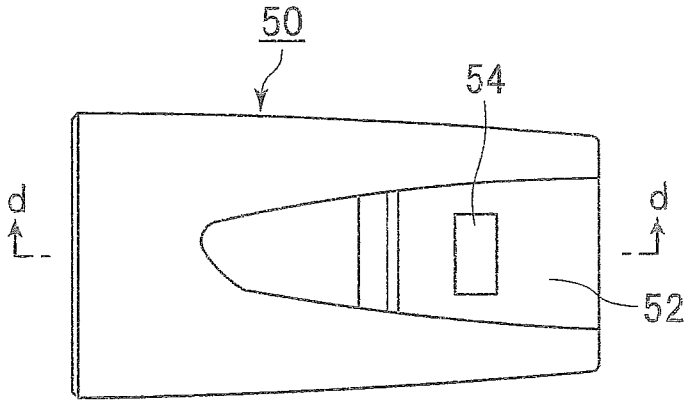
FIG. 5(A) is an enlarged external appearance view of a rear tube of the stick-shaped material propelling container shown in FIG. 1.
Figure 5B:
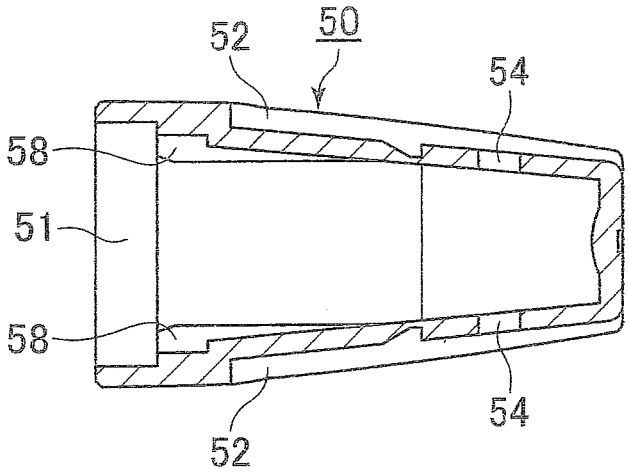
FIG. 5(B) is a sectional view of the rear tube, taken along a line d-d in FIG. 5(A)
Figure 5C:
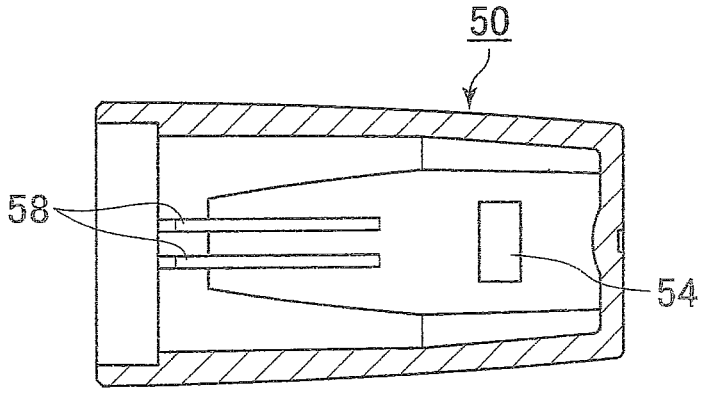
FIG. 5(C) is a sectional view of the rear tube which is different from the sectional view shown by FIG. 5(B)

As shown in FIG. 1, the rear side tubular section 20*a* of the guide tube 20 is projected rearward from the open rear end portion 10*a* of the outer barrel 10. A rear tube 50 is fitted around the outer periphery of the rear side tubular section 20*a* through an annular spacer 40. The annular spacer 40 has spaced apart protrusions 41 which are provided on a front end surface of the annular spacer 40 and correspond in number to the arcuate recesses 14*a* of the outer barrel 10. Referring to FIG. 5, the rear tube 50 is formed into a bottomed tube-shape and opened at a tip end portion thereof. An inner peripheral surface of the open tip end portion of the rear tube 50 has an annularly stepped portion and forms an inner peripheral recess 51 in which the spacer 40 can be received. As shown in FIGS. 5(B) and 5(C), a pair of guide ribs 58 is formed integrally with each of regions of an inner peripheral surface of a peripheral wall of the rear tube 50 which are opposite each other in the radial direction of the rear tube 50. The pair of guide ribs 58 extends from the annularly stepped portion of the rear tube 50 toward a rear end of the rear tube 50.

Moreover, the rear tube 50 has outer recess portions 52 formed in opposite regions of an outer peripheral surface of its peripheral wall in the radial direction of the rear tube 50, and extending toward a tip end from the rear end of the rear tube 50. Bottom portions of the recess portions 52 are formed with through-holes 54 in which the engagingly stopping pawls 28*a* of the guide tube 20 are engaged. Moreover, a decorative cover 60 for covering the through-holes 54 is fitted in the recess portions 52 of the rear tube 50 as shown in FIG. 1.

In this embodiment, the rear tube 50 serves both as a cover member for covering the rear side tubular section 20*a* of the guide tube 20 and as an operating member for performing the relative rotation of the guide tube 20 and the outer barrel 10. For example, when a user grips the outer barrel 10 by one of his/her hands and causes the rear tube 50 to be rotated relative to the outer barrel 10 by the other of his/her hands, the guide tube 20 connected to the rear tube 50 is rotated relative to the outer barrel 10, whereby the holding member 30 is moved in a forward/rearward direction in the guide tube 20.

When the stick-shaped material propelling container according to the embodiment is assembled, the guide tube 20 having the holding member 30 contained therein is inserted at the engagingly stopping pieces 28 thereof into the open tip end portion 10*b* of the outer barrel 10 and further inserted into the outer barrel 10 until the flange portion 24 of the guide tube 20 is abutted against a front surface of the tip end portion 10*b* of the outer barrel 10. In the state where the guide tube 20 has been fully inserted into the outer barrel 10, the rear side tubular section 20*a* of the guide tube 20 is projected rearward from the open rear end portion 10*a* of the outer barrel 10. In this state, by inserting the engagingly stopping pieces 28 of the guide tube 20 into the annular spacer 40, causing the spacer 40 to go forward over the stopper protrusions 26*a* of the guide tube 20 while allowing the spacer 40 to deform the stopper protrusions 26*a* inward in the radial direction of the guide tube 20, and then causing the protrusions 41 of the spacer 40 to be engaged in the arcuate recesses 14*a* of the step-shaped portion 14 of the outer barrel 10, the spacer 40 is disposed among the outer peripheral surface of the rear side tubular section 20*a* of the guide tube 20, the step-shaped portion 14 of the outer barrel 10, and the stopper protrusions 26*a* of the guide tube 20. Then, by causing the rear side tubular section 20*a* of the guide tube 20 to be inserted into the rear tube 50 through the open tip end portion of the rear tube 50, causing each of the engagingly stopping ribs 27*a* of the guide tube 20 to be inserted between a corresponding pair of guide ribs 58 of the rear tube 50, and then causing the engagingly stopping pawls 28*a* provided at the engagingly stopping pieces 28 of the guide tube 20 to be engaged in the through-holes 54 of the rear tube 50, the rear tube 50 is fitted around the rear side tubular section 20*a* of the guide tube 20 which includes the spacer 40. Thus, the guide tube 20 which is connected to the rear tube 50 in this way is made unmovable in the axial direction thanks to the abutment of the flange portion 24 against the front surface of the tip end portion 10*b* of the outer barrel 10 and the engagement between the engagingly stopping pawls 28*a* of the guide tube 20 and the through-holes 54 of the rear tube 50.

Incidentally, while the spacer 40 is employed in this embodiment, the spacer 40 is not always required if the guide tube 20 is designed so that it is rotatable relative to the outer barrel 20. Also, the rear tube 50 on which the decorative cover 60 is fitted is not always required. That is, if the rear side tubular section 20*a* of the guide tube 20 is projected rearward from the rear end portion 10*a* of the outer barrel 10 as described above and the guide tube 20 is designed so that it is rotatable relative to the outer barrel 10 and locked with respect to the outer barrel 10 so as to be unmovable in the axial direction, the rear tube 50 is not required. In this case, the user grips the rear side tubular section 20*a* of the guide tube 20 with one of his/her hands, grips the outer barrel 10 with the other of his/her hands, and can then perform the relative rotation of the guide tube 20 and the outer barrel 10. Therefore, in this case, the engagingly stopping pieces 28 provided with the engagingly stopping pawls 28*a* which are engaged in the through-holes 54 of the rear tube 50 are not required to be provided at the rear side tubular section 20*a* of the guide tube 20.

Referring to FIG. 4, the holding member 30 comprises a bottom plate 32 on which the stick-shaped material M is carried, two side plates 34 for interposingly holding the stick-shaped material M carried on the bottom plate 32, the two side plates 34 extending in the forward/rearward direction from side edge regions of the bottom plate 32, and engaging protrusions 34*a* provided on regions of the side plates 34 which are adjacent to rear ends of the side plates 34 with respect to the bottom plate 32. The engaging protrusions 34*a* protrude laterally from the regions of the side plates 34 which are adjacent to the rear ends of the side plates 34 with respect to the bottom plate 32. Incidentally, tip end portions of the side plates 34 of the holding member 30 mean "end portions of the side plates which are disposed adjacent to the flange portion 24 of the guide tube 20 when the holding member 30 is received in the guide tube 20", and rear end portions of the side plates 34 of the holding member 30 means "end portions of the side plates which are disposed adjacent to the rear side tubular section 20*a* of the guide tube 20 when the holding member 30 is received in the guide tube 20".

Figure 4A:
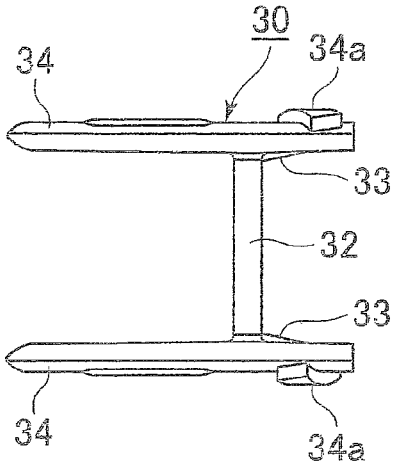
FIG. 4(A) is an enlarged external appearance view of a holding member.
Figure 4B:
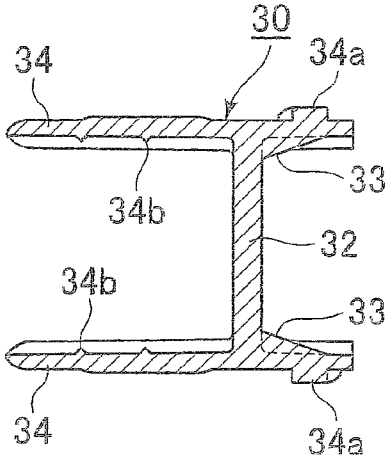
FIG. 4(B) is an enlarged sectional view of the holding member.
Figure 4C:
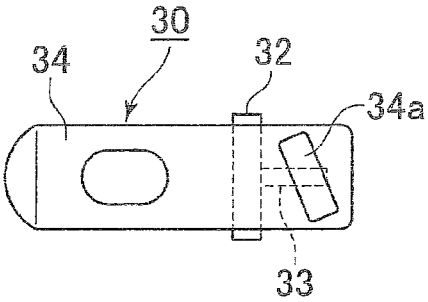
FIG. 4(C) is an enlarged plane view of the holding member.
Figure 4D:
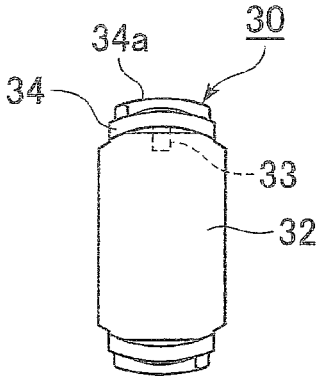
FIG. 4(D) is an enlarged side view of the holding member.

As shown in FIG. 4(B), the holding member 30 further has a plurality of small protrusions 34*b* provided on inner surfaces of the side plates 34. Moreover, reinforcement ribs 33 are provided at corner portions between a rear surface of the bottom plate 32 and the inner surfaces of the side plates 34. In this embodiment, the holding member 30 is made of flexible resin material and formed as one piece member comprising the bottom plate 32, the side plates 34, the reinforcement ribs 33, the engaging protrusions 34*a*, and the small protrusions 34*b*. However, the holding member 30 may be assembled from several separate components.

The stick-shaped material M is held by the holding member 30 in a state where one end portion of the stick-shaped material is carried on the bottom plate 32, and a peripheral surface of the stick-shaped material is interposedly held between the two side plates 34. In this state, the small protrusions 34*b* which are provided on the inner surfaces of the side plates 34 bite into the peripheral surface of the stick-shaped material M.

In the illustrated embodiment, the holding member 30 is slidably received in the guide tube 20 with the side plates 34 thereof being engaged with the guide slits 22 of the guide tube 20 and with the engaging protrusions 34*a* thereof being engaged with the spiral groove 12 of the outer barrel 10 through the guide slits 22. Concretely, the holding member 30 is slidably received in the guide tube 20 with the side plates 34 thereof being idly engaged in the guide slits 22 of the guide tube 20 and with the engaging protrusions 34*a* thereof being idly engaged in the spiral groove 12 of the outer barrel 10 through the guide slits 22 of the guide tube 20. The holding member 30 is adapted to be slidable in the forward/rearward direction along the guide slits 22 in the guide tube 20. Incidentally, the side plates 34 of the holding member 30 are not always required to be idly engaged in the guide slits 22. For example, a structure may be employed in which the side plates 34 are disposed inward relative to the guide slits 22 and at least the engaging protrusions 34*a* are engaged in the spiral groove 12 of the outer barrel 10 through the guide slits 22 of the guide tube 20.

Regarding the rotation direction of the rear tube 50 and guide tube 20 relative to the outer barrel 10, a rotation direction of them which allows the forward movement of the holding member 30 is hereinafter referred to as "a normal rotation direction", and a rotation direction of them which allows the rearward movement of the holding member 30 is hereinafter referred to as "a reverse rotation direction".

Figure 6:
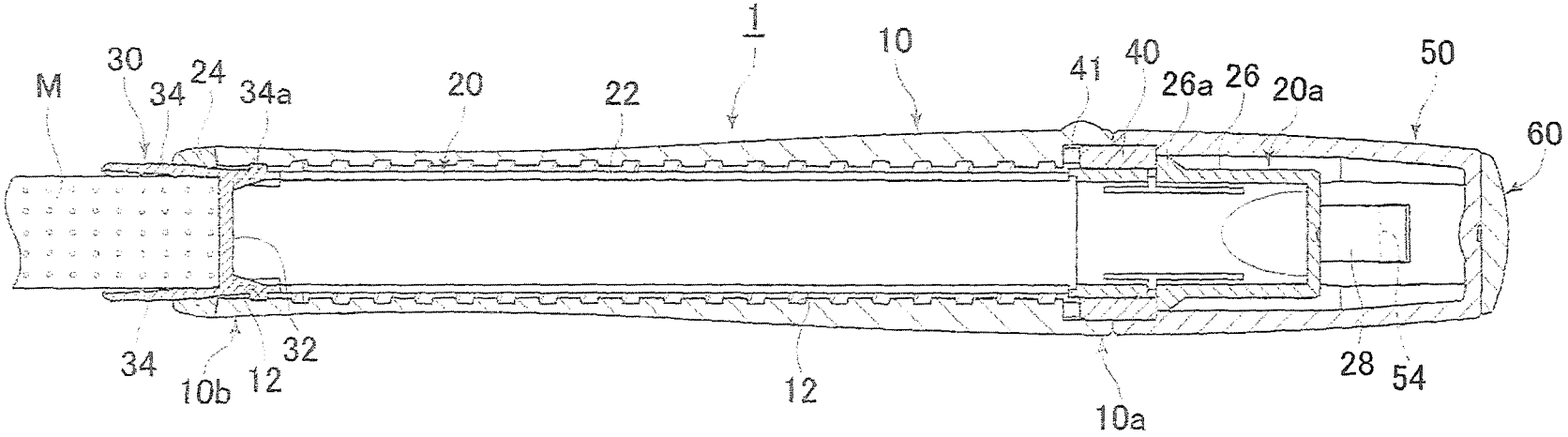
FIG. 6 is a vertically sectional view of the stick-shaped material propelling container, in which tip end portions of two side plates of the holding member holding a stick-shaped material are brought into a state where they are operatively projected out of an open tip end portion of the outer barrel by causing the guide tube to be rotated relative to the outer barrel several times.

In the stick-shaped material propelling container 1 of the embodiment of the present invention which is constructed as described above, the holding member 30 is adapted to be moved in the forward/rearward direction in the guide tube 20 by causing the outer barrel 10 and the guide tube 20 to be rotated relative to each other. More particularly, when the outer barrel 10 and the rear tube 50 are rotated relative to each other in the directions which allow the holding member 30 to be moved forward, the guide tube 20 connected to the rear tube 50 is also rotated relative to the outer barrel 10. Concretely, when the rear tube 50 is rotated relative to the outer barrel 10 in the normal rotation direction, the guide tube 20 connected to the rear tube 50 is also rotated in the normal rotation direction. Thereby, the engaging protrusions 34*a* of the holding member 30 in the guide tube 20 are slid along the spiral groove 12 of the outer barrel 10 to thereby cause the holding member 30 to be rotated relative to the outer barrel 10 in the normal rotation direction while being moved forward along the guide slits 22 of the guide tube 20 (see FIG. 6). The spiral groove 12 has a structure for causing the rear end portions of the side plates 34 of the holding member 30 to be deformed radially inward or come closer to each other in the radial direction of the outer barrel 10 and for causing the tip end portions of the side plates 34 of the holding member 30 to be deformed radially outward or be separated radially outward from each other according to the mutually approaching movements of the rear end portions of the side plates 34 of the holding member 30, when the engaging protrusions 34*a* of the holding member 30 are slid along a tip end portion of the spiral groove 12. More particularly, when the engaging protrusions 34*a* of the holding member 30 are slid forward along a first spiral groove portion 12*a* of the spiral groove 12 (see FIG. 7) which is formed in an inner peripheral surface of the tip end portion 10*b* of the outer barrel 10 and occupies the tip end portion of the spiral groove 12, the first spiral groove portion 12*a* of the spiral groove 12 serves to cause the rear end portions of the two side plates 34 of the holding member to come closer to each other in the radial direction of the outer barrel 10 and cause the tip end portions of the two side plates 34 of the holding member 30 to be separated outward from each other in the radial direction of the outer barrel 10, namely, increase an interval between the tip end portions of the two side plates 34 of the holding member 30 (see FIG. 8(B)).

Figure 7:
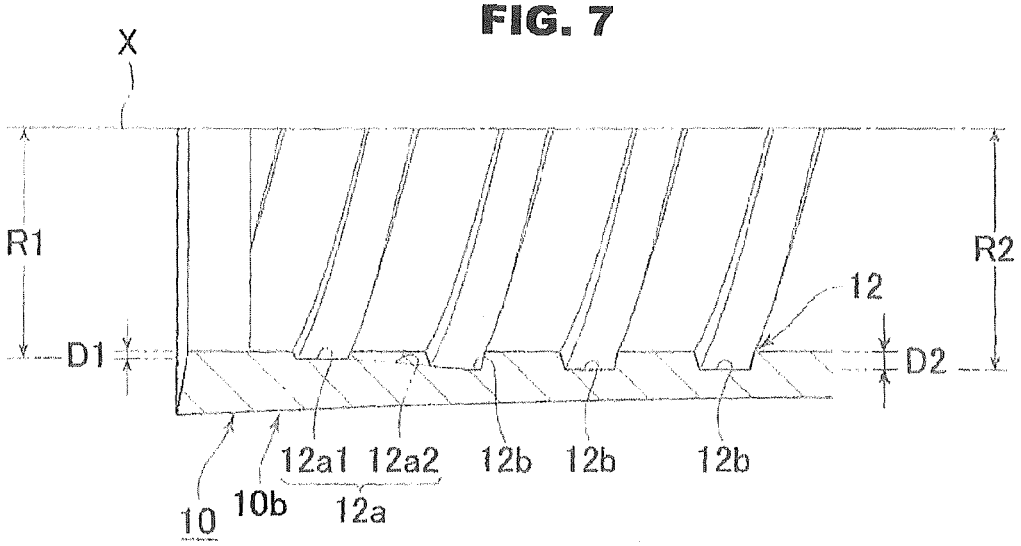
FIG. 7 is an enlarged segmentary sectional view of the open tip end portion of the outer barrel which is of assistance in explaining a structure of a spiral groove formed in an inner peripheral surface of the outer barrel.

The first spiral groove portion 12*a* of the spiral groove 12 of the outer barrel 10 which serves to increase the interval between the tip end portions of the two side plates 34 of the holding member 30 may be structured as follows. Referring to FIG. 7, in addition to the first spiral groove portion 12*a*, the spiral groove 12 includes a second spiral groove portion 12*b* continuously extending rearward from a rear end of the first spiral groove portion 12*a*. The first spiral groove portion 12*a* of the spiral groove 12 which is formed in the inner peripheral surface of the tip end portion 10*b* of the outer barrel 10 comprises a forward spiral groove region 12*a*1 occupying a frontmost part of the spiral groove 12, and a rearward spiral groove region 12*a*2 continuously extending rearward from a rear end of the forward spiral groove region 12*a*1. A radius R1 which is measured between a virtual axial-center line X of the outer barrel 10 (see FIGS. 1(A) and 7) and the forward spiral groove region 12*a*1 of the first spiral groove portion 12*a* is shorter than a radius R2 which is measured between the virtual axial-center line X and the second spiral groove portion 12*b*.

The above-mentioned structure of the spiral groove 12 makes it possible to cause the rear end portions of the two side plates 34 to come closer to each other according to the forward movement of the engaging protrusions 34*a* of the holding member 30 along the first spiral groove portion 12*a* and to cause the tip end portions of the two side plates 34 to be separated radially outward from each other according to the mutually approaching movements of the rear end portions of the two side plates 34. Thereby, the interval between the tip end portions of the two side plates 34 is increased, thus making it possible for the stick-shaped material M to be easily removed from the holding member 30. Therefore, it is possible to replace the stick-shaped material M held by the holding member 30, with another stick-shaped material having the substantially same diameter as the stick-shaped material M has.

More particularly, a depth of the first spiral groove portion 12*a* may be made shallower than a depth of the second spiral groove portion 12*b*. In this case, according to the forward sliding movement of the engaging protrusions 34*a* of the holding member 30 along the first spiral groove portion 12*a* of the tip end portion 10*b* of the outer barrel 10, the rear end portions of the two side plates 34 are allowed to come closer to each other in the radial direction of the outer barrel 10 and, according to the mutually approaching movements of the rear end portions of the two side plates 34, the tip end portions of the two side plates 34 which are projected out of the open tip end portion 10*b* of the outer barrel 10 are separated outward from each other in the radial direction of the outer barrel 10.

More particularly, the second spiral groove portion 12*b* which is disposed on a rear side relative to the rearward spiral groove region 12*a*2 of the first spiral groove portion 12*a* extends continuously from a rear end of the rearward spiral groove region 12*a*2 toward the vicinity of the step-shaped portion 14 of the outer barrel 10. A depth D1 of the forward spiral groove region 12*a*1 is made shallower than a depth D2 of the second spiral groove portion 12*b*. Moreover, a groove-transition region between the forward spiral groove region 12*a*1 and the rearward spiral groove region 12*a*2 has the same depth D1 as the forward spiral groove region 12*a*1 has, and a groove-transition region between the rearward spiral groove region 12*a*2 and the second spiral groove portion 12*b* has the same depth D2 as the second spiral groove portion 12*b* has. Therefore, the depth of the rearward spiral groove region 12*a*2 is made gradually shallower from the second spiral groove portion 12*b* to the forward spiral groove region 12*a*1.

Figure 8A:
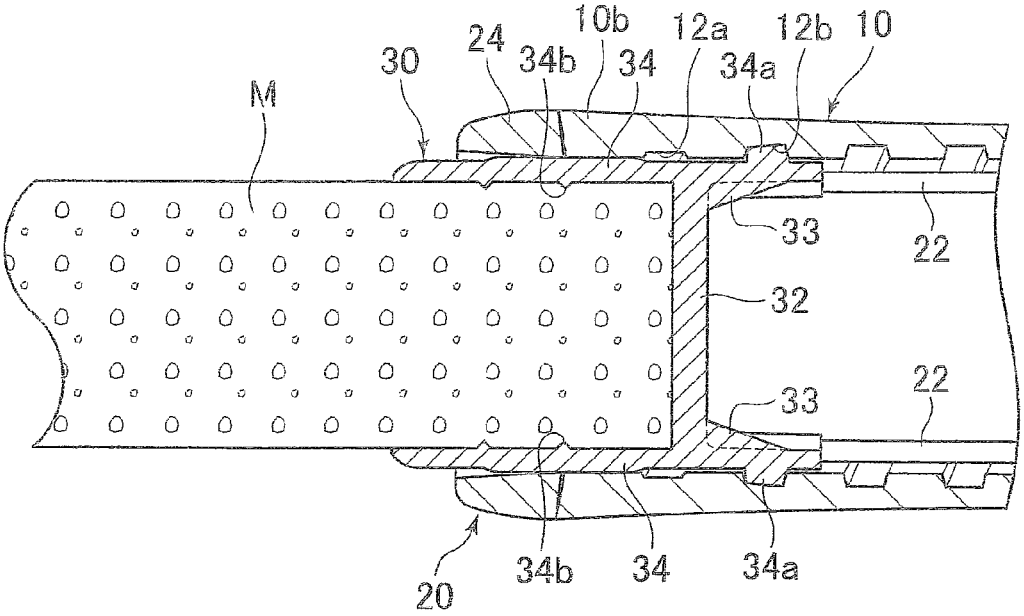
FIG. 8(A) is an enlarged sectional view showing a state where engaging protrusions of the holding member do not arrive at a forward spiral groove region of a first spiral groove portion of the spiral groove formed in the outer barrel.
Figure 8B:
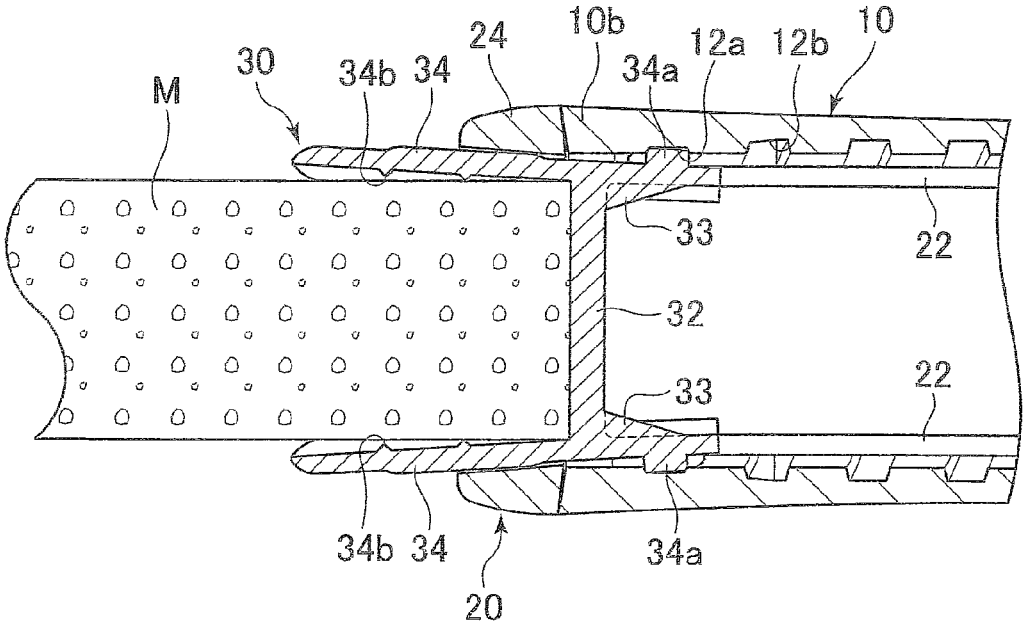
FIG. 8(B) is an enlarged sectional view showing a state where the engaging protrusions of the holding member arrive at the forward spiral groove region of the first spiral groove portion and, according to mutually approaching movements of rear end portions of the two side plates of the holding member in a radial direction of the outer barrel, the tip end portions of the two side plates of the holding member are separated outward from each other in the radial direction of the outer barrel.

In a state where, as shown in FIG. 8(A), the tip end portions of the side plates 34 of the holding member 30 are projected forward from the open tip end portion 10*b* of the outer barrel 10 and the engaging protrusions 34*a* of the holding member 34 do not yet arrive at the first spiral groove portion 12*a* from the second spiral groove portion 12*b*, the tip end portions of the two side plates 34 of the holding member 30 are not yet separated outward from each other in the radial direction of the outer barrel 10. When the tip end portions of the side plates 34 of the holding member 30 are further projected forward from the open tip end portion 10*b* of the outer barrel 10 and the engaging protrusions 34*a* of the holding member 30 arrive at the first spiral groove portion 12*a* from the second spiral groove portion 12*b*, the rear end portions of the side plates 34 of the holding member 30 come closer to each other in the radial direction of the outer barrel 10 as shown in FIG. 8(B). According to the mutually approaching movements of the rear end portions of the side plates 34, the tip end portions of the side plates 34 are separated outward from each other in the radial direction of the outer barrel 10. As a result, the interval between the tip end portions of the side plates 34 is increased, thus making it possible for the stick-shaped material M to be easily removed from the holding member 30. Incidentally, the grooves 24*a* which are formed in the inner peripheral surface of the flange portion 24 of the guide tube 20 are made gradually deeper toward the front ends from the rear ends thereof as described above, so that when the engaging protrusions 34*a* of the holding member 30 arrive at the first spiral groove portion 12*a* from the second spiral groove portion 12*b*, the tip end portions of the side plates 34 of the holding member 30 can be easily opened relative to each other.

As discussed above, the depth D1 of the forward spiral groove region 12*a*1 of the first spiral groove portion 12*a* is made shallower than the depth of the rearward spiral groove region 12*a*2 of the first spiral groove portion 12*a* and the depth of the second spiral groove portion 12*b*, so that when the engaging protrusions 34*a* of the holding member 30 arrive at the forward spiral groove region 12*a*1 of the spiral groove 12, the interval between the tip end portions of the two side plates 34 of the holding member 30 can be easily increased. Thus, according to the present invention, it is possible to realize the stick-shaped material propelling container which has the simple structure for allowing the stick-shaped material M to be easily removed from the holding member 30. Incidentally, in the state where the tip end portion of the stick-shaped material M held by the holding member 30 is propelled out of the open tip end portion of the outer barrel 10 by causing the guide tube 20 to be rotated relative to the outer barrel 10 in the normal rotation direction, the stick-shaped material M is used. When the stick-shaped material M is not required to be used, the stick-shaped material M is retracted in the guide tube 20 by causing the guide tube 20 to be rotated relative to the outer barrel 10 in the reverse rotation direction.

(First Variant)

Figure 9A:
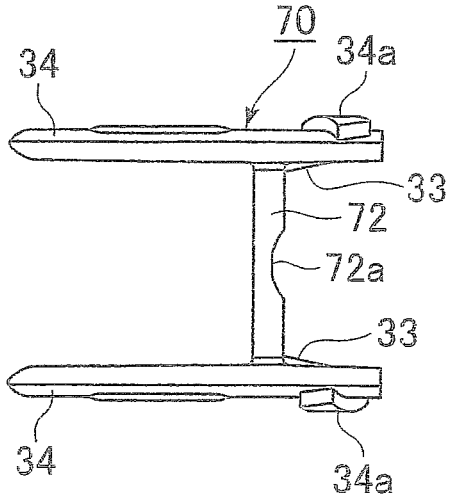
FIG. 9(A) is an enlarged external appearance view of a first variant of the holding member shown in FIG. 4.
Figure 9B:
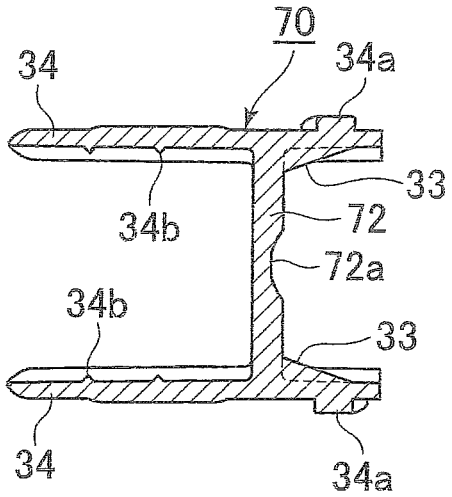
FIG. 9(B) is a sectional view of the first variant shown in FIG. 9(A)

Next, a first variant of the holding member 30 of the above-mentioned embodiment will be discussed with reference to FIG. 9. While the bottom plate 32 of the holding member 30 of the above-mentioned embodiment has a substantially constant thickness, a bottom plate 72 between two side plates 34 of a holding member 70 according to the first variant is formed in such a manner that a thickness of a middle portion of the bottom plate 72 is thinner than a thickness of a remaining portion around the middle portion. More concretely, a middle portion of a rear surface of the bottom plate 72 between the two side plates 34 is formed with a depressed portion 72*a*. The remaining portions of the holding member 70 are constructed in the same manner as those of the holding member 30 shown in FIG. 4 are done and, therefore, the description of them is omitted. The provision of the depressed portion 72*a* in the rear surface of the bottom plate 72 makes the bottom plate 72 easy to be flexibly deformed, when the engaging protrusions 34*a* of the holding member 70 are slid along the first spiral groove portion 12*a* which is formed in the tip end portion 10*b* of the outer barrel 10. Therefore, the flexible deformation of the bottom plate 72 facilitates the mutually approaching movements of the rear end portions of the side plates 34 in the radial direction and facilitates the radially outward separating movements of the tip end portions of the side plates 34 according to the mutually approaching movements of the rear end portions of the side plates 34 in the radial direction. Moreover, the flexible deformation of the bottom plate 72 allows a contact area between the bottom plate 72 and the stick-shaped material M to be reduced, so that the stick-shaped material can be more easily removed from the holding member 70.

(Second Variant)

Figure 10A:
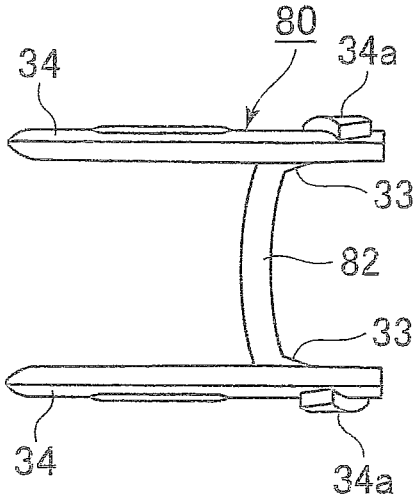
FIG. 10(A) is an enlarged external appearance view of a second variant of the holding member shown in FIG. 4.
Figure 10B:
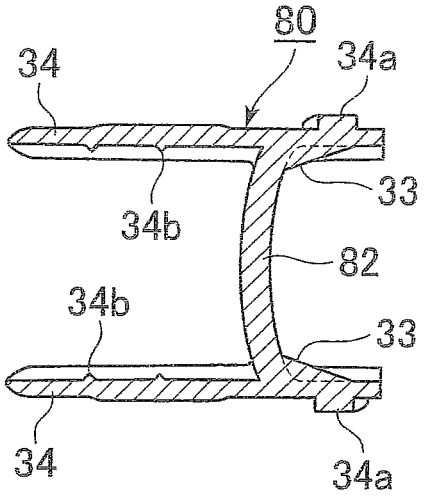
FIG. 10(B) is a sectional view of the second variant shown in FIG. 10(A).

Next, a second variant of the holding member 30 of the above-mentioned embodiment will be discussed with reference to FIG. 10. While the bottom plate 32 of the holding member 30 of the above-mentioned embodiment is formed in a flat-plate shape, a bottom plate 82 of a holding member 80 according to the second variant is formed so as to be curved as shown in FIG. 10. More concretely, the bottom plate 82 is formed in such a manner that a portion of the bottom plate 82 which is spaced at an equal interval from the side plates 34 (in this variant, a middle portion of the bottom plate 82 between the two side plates 34) is curved so as to protrude forward as compared to a remaining portion around the portion of the bottom plate 82. The remaining portions of the holding member 80 are constructed in the same manner as those of the holding member 30 shown in FIG. 4 are done and, therefore, the description of them is omitted. The bottom plate 82 of the holding member 80 is constructed in this way, so that the bottom plate 82 is made easy to be flexibly deformed when the engaging protrusions 34*a* of the holding member 80 are slid along the first spiral groove portion 12*a* which is formed in the tip end portion 10*b* of the outer barrel 10. Therefore, the flexible deformation of the bottom plate 82 facilitates the mutually approaching movements of the rear end portions of the side plates 34 in the radial direction and facilitates the radially outward separating movements of the tip end portions of the side plates according to the mutually approaching movements of the rear end portions of the side plates 34. Moreover, a contact area between the bottom plate 82 and the stick-shaped material M is reduced by the flexible deformation of the bottom plate 82, so that the stick-shaped material can be more easily removed from the holding member 80.

Incidentally, the present invention is not limited to the above-mentioned embodiments, and various variants and modifications can be made without departing from the gist of the present invention. Although the case where the two guide slits are formed in the guide tube and the two side plates are provided at the holding member has been described above, it is apparent that the present invention may be applied to, for example, a case where three or more guide slits are formed in the guide tube and side plates corresponding in number to the guide slits are provided at the holding member. Moreover, although the tip and rear end portions of the outer barrel are both opened and the rear end portion of the guide tube is projected rearward from the open rear end portion of the outer barrel in the above-mentioned embodiments, the outer barrel may be opened only at the tip end portion thereof. For example, a length of the guide tube is made shorter than a length of the outer barrel, or the length of the outer barrel is made longer than the length of the guide tube, in order that the guide tube is received in the outer barrel with the rear side tubular section thereof being not projected out of the rear end portion of the outer barrel. In this case, the user can cause the holding member to be moved in the forward/rearward direction in the guide tube by pinching the flange portion of the guide tube with his/her fingers and causing the guide tube to be rotated relative to the outer barrel.

REFERENCE SIGN LIST

1: Stick-shaped material propelling container
10: Outer barrel
10*a*: Rear end portion
10*b*: Tip end portion
12: Spiral groove
12*a*: First spiral groove portion
12*a*1: Forward spiral groove region
12*a*2: Rearward spiral groove region
12*b*: Second spiral groove portion
14: Step-shaped portion
14*a*: Arcuate recess
20: Guide tube
20*a*: Rear side tubular portion
20*b*: Front side tubular portion
20*c*: Bottom portion
22: Guide slit
24: Flange portion
24*a*: Groove
26: Stopper piece
26*a*: Stopper protrusion
26*b*: Cut
27: Step portion
27*a*: Stoppingly engaging rib
28: Stoppingly engaging piece
28*a*: Stoppingly engaging pawl
30, 70, 80: Holding member
32, 72, 82: Bottom plate
33: Reinforcement rib
34: Side plate
34*a*: Engaging protrusion
34*b*: Small protrusion
40: Spacer
41: Protrusion
50: Rear tube
51: Inner peripheral recess
52: Outer recess portion
54: Through-hole
58: Guide rib
60: Decorative cover
72*a*: Depressed portion
M: Stick-shaped material
D1, D2: Depth of spiral groove portion
R1, R2: Radius
X: Virtual axial-center line

What is claimed is:

1. A stick-shaped material propelling container comprising:

an outer barrel opened at least at a tip end portion thereof and having a spiral groove formed in an inner peripheral surface thereof;

a guide tube opened at least at a tip end portion thereof and having a peripheral wall and a plurality of axially extending guide slits formed in the peripheral wall;

the guide tube being inserted in the outer barrel so as to be rotatable relative to the outer barrel and unmovable in an axial direction of the outer barrel; and a holding member for holding a stick-shaped material;

the holding member comprising a bottom plate, on which the stick-shaped material is carried, a plurality of side plates for interposingly holding the stick-shaped material carried on the bottom plate, the plurality of side plates extending in a forward/rearward direction from side edge regions of the bottom plate, and engaging protrusions protruding laterally from rear end portions of the side plates with respect to the bottom plate;

the holding member being slidably inserted in the guide tube in a state where the side plates or the engaging protrusions of the holding member are engaged with the guide slits of the guide tube, and the engaging protrusions of the holding member are engaged with the spiral groove of the outer barrel through the guide slits of the guide tube; and the holding member being adapted to be moved in the forward/rearward direction along the guide slits of the guide tube while being rotated relative to the outer barrel with the engaging protrusions being slid along the spiral groove of the outer barrel, by relative rotation of the outer barrel and the guide tube; wherein the spiral groove has a structure for causing rear end portions of the side plates of the holding member to come closer to each other in a radial direction of the outer barrel and for causing tip end portions of the side plates of the holding member to be separated radially outward from each other according to the mutually approaching movements of the rear end portions of the side plates of the holding member, when the engaging protrusions of the holding member are slid along a tip end portion of the spiral groove according to the relative rotation of the outer barrel and the guide tube.

2. The stick-shaped material propelling container according to claim 1, wherein the structure of the spiral groove comprises a first spiral groove portion formed in an inner peripheral surface of the tip end portion of the outer barrel, and a second spiral groove portion continuously extending rearward from a rear end of the first spiral groove portion, and a radius which is measured between a virtual axial-center line of the outer barrel and the first spiral groove portion is made shorter than a radius which is measured between the virtual axial-center line and the second spiral groove portion.

3. The stick-shaped material propelling container according to claim 2, wherein a middle region of the bottom plate between the side plates of the holding member is made thinner than a remaining region of the bottom plate around the middle region.

4. The stick-shaped material propelling container according to claim 3, wherein a middle region of a rear surface of the bottom plate between the side plates of the holding member is formed with a depressed portion.

5. The stick-shaped material propelling container according to claim 2, wherein a middle region of the bottom plate which is spaced at an equal interval from the side plates of the holding member is curved so as to protrude forward as compared to a remaining region of the bottom plate around the middle region.

6. The stick-shaped material propelling container according to claim 2, wherein a depth of the first spiral groove portion is made shallower than a depth of the second spiral groove portion.

7. The stick-shaped material propelling container according to claim 6, wherein a middle region of the bottom plate between the side plates of the holding member is made thinner than a remaining region of the bottom plate around the middle region.

8. The stick-shaped material propelling container according to claim 7, wherein a middle region of a rear surface of the bottom plate between the side plates of the holding member is formed with a depressed portion.

9. The stick-shaped material propelling container according to claim 6, wherein a middle region of the bottom plate which is spaced at an equal interval from the side plates of the holding member is curved so as to protrude forward as compared to a remaining region of the bottom plate around the middle region.

10. The stick-shaped material propelling container according to claim 1, wherein a middle region of the bottom plate between the side plates of the holding member is made thinner than a remaining region of the bottom plate around the middle region.

11. The stick-shaped material propelling container according to claim 10, wherein a middle region of a rear surface of the bottom plate between the side plates of the holding member is formed with a depressed portion.

12. The stick-shaped material propelling container according to claim 1, wherein a middle region of the bottom plate which is spaced at an equal interval from the side plates of the holding member is curved so as to protrude forward as compared to a remaining region of the bottom plate around the middle region.

* * * * *